US006470845B2

(12) United States Patent
Kanao

(10) Patent No.: US 6,470,845 B2
(45) Date of Patent: Oct. 29, 2002

(54) SPARK PLUG FOR INTERNAL COMBUSTION ENGINE

(75) Inventor: Keiji Kanao, Aichi-ken (JP)

(73) Assignee: Denso Corporation, Kariya (JP)

( * ) Notice: Subject to any disclaimer, the term of this patent is extended or adjusted under 35 U.S.C. 154(b) by 4 days.

(21) Appl. No.: 09/820,755

(22) Filed: Mar. 30, 2001

(65) Prior Publication Data

US 2001/0029916 A1 Oct. 18, 2001

(30) Foreign Application Priority Data

Mar. 30, 2000 (JP) ..... 2000-095020
Dec. 4, 2000 (JP) ..... 2000-368502

(51) Int. Cl.[7] ..... H01T 13/20

(52) U.S. Cl. ..... 123/169 EL; 123/169 R; 313/141; 313/142

(58) Field of Search ..... 123/169 R, 169 EL; 313/141, 142

(56) References Cited

U.S. PATENT DOCUMENTS 5,461,275 A * 10/1995 Oshima ..... 123/169 EL
5,873,338 A * 2/1999 Matsubara et al. ... 123/169 EL
5,898,257 A 4/1999 Sequerra et al.
6,094,000 A 7/2000 Osamura et al.
6,147,441 A 11/2000 Osamura
6,316,868 B1 * 11/2001 Ishino et al. ..... 313/123
6,346,766 B1 * 2/2002 Kanao et al. ..... 313/141

FOREIGN PATENT DOCUMENTS

DE 196 50 728 6/1997
GB 2 184 484 6/1987

* cited by examiner

*Primary Examiner*—Erick Solis
(74) *Attorney, Agent, or Firm*—Nixon & Vanderhye P.C.

(57) ABSTRACT

In a spark plug for an internal combustion engine, having a fitting screw portion with a diameter of M10. An axial distance A between an end surface of a fitting piece and an other end surface of a noble metal chip is set within a range of 3 mm to 8 mm, and the other end surface has an area S set within a range of 0.07 $mm^2$ to 0.55 $mm^2$. One end portion of a ground electrode is a fitted to the end surface of the fitting piece, and the other end portion is inclined toward the noble metal chip at a slant angle of θ with respect to an axial length so as to provide a discharge gap G between the noble chip and the other end portion. The slant angle θ is set within a range of 40°to 70°, and the discharge gap G is set within a range of 0.7 mm to 0.9 mm. According to the structure, it is possible to sufficiently protrude the spark position of the spark plug.

10 Claims, 9 Drawing Sheets

SPARK PLUG FOR INTERNAL COMBUSTION ENGINE

BACKGROUND OF THE INVENTION

1. Field of the Invention

The present invention relates to a spark plug for an internal combustion engine and, more particularly, to a small-sized spark plug with a fitting piece on which an M10 screw portion is mounted.

2. Description of the Prior Art

Recently, for improving output of an internal combustion engine, it is necessary to make large a valve size of an intake manifold or an exhaust manifold. Thus, in order to keep a space surrounding the combustion chamber of the engine, it is required for miniaturizing a spark plug fitted to the internal combustion engine, that is, making small a diameter of a fitting piece of the spark plug.

As conventional small-sized spark plugs, for example, there is disclosed a spark plug in U.S. Pat. No. 6,147,441.

However, in the conventional small-sized spark plug for the internal combustion engine, which has an M10 (ISO2704) screw portion fitted to the fitting piece thereof, especially, a wall thickness of the fitting piece is small so that it is also required to miniature a ground electrode welded to the fitting piece, such as, to make thin the ground electrode.

Therefore, it is impossible to secure the heat resistance of the ground electrode itself due to the miniaturization of the ground electrode, so that there is the possibility that it is unable to sufficiently project a spark position into the combustion chamber of the engine.

Furthermore, because the screw portion has a small-size with a screw diameter of substantially M10, a distance between an insulator supporting a center electrode and the fitting piece is made short, so that side sparks, that is, electric discharges which are generated from the center electrode to the insulator are easily caused, whereby it is hard to generate normal discharges between the center electrode and the ground electrode.

SUMMARY OF THE INVENTION

The present invention is directed to overcome the foregoing problems. Accordingly, it is an object of the present invention to provided a spark plug for an internal combustion engine, which is configured to permit a spark position to sufficiently project, while preventing side sparks from generating, so as to make sure an ignitability thereof.

In order to achieve such object, according to one aspect of the present invention, there is provided a spark plug for an internal combustion engine, comprising a center electrode with an end portion; an insulator surrounding a periphery of the center electrode to support the center electrode; a fitting piece that supports the insulator, the fitting piece being provided with an end surface and at a periphery thereof with a fitting screw portion, the end portion of the center electrode projecting from the end surface of the fitting piece, the fitting screw portion having a diameter of M10; a noble metal chip with one end surface and other end surface opposite thereto, the one end surface being mounted on the end portion of the center electrode, the other end surface being arranged so that an axial distance A between the end surface of the fitting piece and the other end surface of the noble metal chip is set within a range of 3 mm to 8 mm, the other end surface having an area S which is set within a range of 0.07 $mm^2$ to 0.55 $mm^2$; and a ground electrode having one end portion and other end portion, the one end portion thereof being fitted to the end surface of the fitting piece, the other end portion being inclined toward the noble metal chip at a slant angle of θ with respect to an axial length of the spark plug so as to provide a discharge gap G between the noble chip and the other end portion, the slant angle θ being set within a range of 40° to 70°, the discharge gap G being set within a range of 0.7 mm to 0.9 mm.

According to the structure of the present invention, in the spark plug for an internal combustion engine having the fitting piece with the M10 screw portion, because the projection length A, the slant angle θ, the area S of the other end surface of the noble metal chip and the discharge gap G are configured to have the above dimensions, respectively, it is possible to sufficiently protrude the spark position of the spark plug, and to prevent side sparks from occurring.

That is, in a case where the projection length (dimension) A between the end surface of the fitting piece and the other end surface of the noble metal chip is less than 3 mm, when the side sparks occur, creepage distances in the surface of the insulator between the center electrode and the fitting piece are made short, the side sparks easily occur.

Moreover, the projection length A is less than 3 mm, it is unable to sufficiently protrude the center electrode in a combustion chamber of the internal combustion engine so that it is impossible to secure a sufficient ignitability. On the contrary, in a case where the projection length A is more than 8 mm , it must be necessary not only to make long the ground electrode corresponding to the projection length A, but also to arrange the tip end portion of the ground electrode in an center side of the combustion chamber so that it must be required for using a ground electrode which has a large heat resistance more than needs.

As described above, the projection length A between the end surface of the fitting piece and the other end surface of the noble metal chip is preferably set within a range defined by the expression:

$$3\ \text{mm} \leq A \leq 8\ \text{mm}.$$

In addition, in a case where the slant angle θ is less than 40°, the configuration of the exhaustion portion of the noble metal chip which is opposite to the ground electrode is too be inclined so that in order to secure a sufficient exhaustion performance of the noble metal chip, it must be required for the noble metal chip having enough length.

However, the longer the length of the noble metal chip is, it is more hard not only to fit the noble metal chip to the one end portion of the center electrode and but also to increase the required amount of the noble metal chip, thereby increasing the cost of the spark plug.

On the contrary, in a case where the slant angle θ is more than 70°, it must be necessary to make long the ground electrode for providing the discharge gap between the other end surface of the noble metal chip and the ground electrode so that the heat resistance of the ground electrode is deteriorated, thereby causing an oxidation of the ground electrode.

As the reasons described above, the slant angle θ is preferably set within a range defined by the expression:

$$40° \leq \theta \leq 70°.$$

In addition, in a case where the area S of the other end surface of the noble metal chip is less than 0.07 $mm^2$, because the exhaustion amount of the noble metal chip strongly increases, it is not practical to use the noble metal chip.

On the contrary, in a case where the area S of the other end surface of the noble metal chip is more than 0.55 $mm^2$, in the process of the growth of a flame core which is generated by an electric discharge occurs in the discharge gap, because the area of the other end surface of the noble metal chip is large, the flame core is easy to contact to the ground electrode so that the contact of the flame core to the ground electrode causes the flame extinction phenomenon such as the transfer of the flame core, thereby deteriorating the ignitability of the spark plug.

As the reasons described above, the area S of the other end surface of the noble metal chip is preferably set within a range defined by the expression:

$$0.07\ mm^2 \leqq S \leqq 0.55\ mm^2.$$

Incidentally, according to the structure of the spark plug with the noble metal chip whose other end surface has the area S within the range of 0.07 $mm^2$ to 0.55 $mm^2$, the discharge gap G is preferably set within a range defined by the expression:

$$0.7\ mm \leqq G \leqq 0.9\ mm.$$

However, in a case where the ground side noble metal chip is mounted on the ground electrode and opposite to the noble metal chip mounted on the end portion of the center electrode, the discharge gap G is preferably set within a range defined by the expression:

$$0.5\ mm \leqq G \leqq 0.9\ mm.$$

The reason is that, because the ground side metal chip is mounted on the ground electrode, as compared with the spark plug without having the ground side noble metal chip, in the process of the growth of the flame core which is generated in the discharge gap, it is possible to prevent the flame core from contacting to the ground electrode 6, thereby improving the ignitability of the spark plug. However, in a case where the discharge gap G is less than 0.5 mm, even if the ground side noble metal chip is mounted on the ground electrode, it is impossible to obtain a sufficient ignitability.

In addition, the area S2 of the end surface of the ground side noble metal chip is preferably set within a range defined by the expression:

$$0.12\ mm^2 \leqq S2 \leqq 0.80\ mm^2.$$

In a case where the area S2 of the end surface of the ground side noble metal chip is less than 0.12 $mm^2$, it is insufficient to exhaust the ground side noble metal chip, thereby to deteriorate the durability of the spark plug. In addition, in a case where the area S2 is more than 0.80 $mm^2$, the ignitability of the spark plug is deteriorated.

Furthermore, the height h between the end surface thereof and the surface of the other end portion of the ground electrode is preferably set within a range defined by the expression:

$$0.3\ mm \leqq h \leqq 1.5\ mm.$$

In a case where the height h between the end surface thereof and the surface of the other end portion of the ground electrode is less than 0.3 mm, it is insufficient to use an edge effect of the ground side noble metal chip, thereby deteriorating the ignitability of the spark plug. In addition, in a case where the height h is more than 1.5 mm, because it is insufficient to transfer the heat in the ground side noble metal chip to the ground electrode, the ground side noble metal chip gets to have high temperature, and the high temperature of the ground side noble metal chip causes the noble side metal chip to be largely exhausted.

Furthermore, it is preferable that the noble metal chip is made of at least one of Ir (iridium) alloy whose at least 60 wt % consists of Ir, such as pure Ir, Ir—Pt (platin) alloy, Ir—Rh alloy and Ir—Ni (nickel) alloy, and Pt alloy at least 60 wt % of which consists of Pt and is formed by adding at least one of pure Pt, Ir, Ni, Pd (palladium), Ru (ruthenium) and W (tungsten).

By using the noble metal chip made by the above materials, it is possible to provide the spark plug for an internal combustion engine, which has a superior durability.

Still furthermore, it is possible that the insulator has a substantially cylindrical shape and is formed at a chip side end with a body portion whole of which has a same diameter in an axial direction thereof.

According to the structure, because the body portion is formed to the chip side end portion of the insulator, it is possible to extend a least distance between the insulator and the fitting piece in an air, making it possible to prevent the generation of the side spark from the center electrode to the ground electrode.

BRIEF DESCRIPTION OF THE DRAWINGS

Other objects and aspects of the present invention will become apparent from the following description of embodiments with reference to the accompanying drawings in which.

DETAILED DESCRIPTION OF THE PREFERRED EMBODIMENTS

The preferred embodiments of the present invention will be described hereinafter with reference to the accompanying drawings.

First Embodiment

Figure 1:
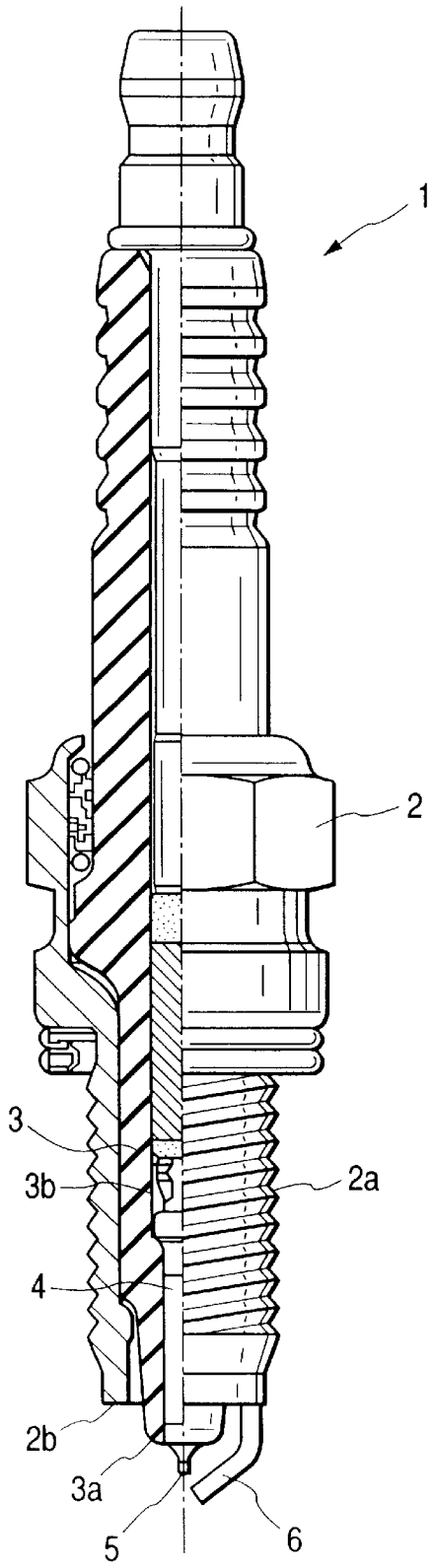
FIG. 1 is a semi-cross sectional view showing a spark plug for an internal combustion engine according to a first embodiment of the present invention.
Figure 2:
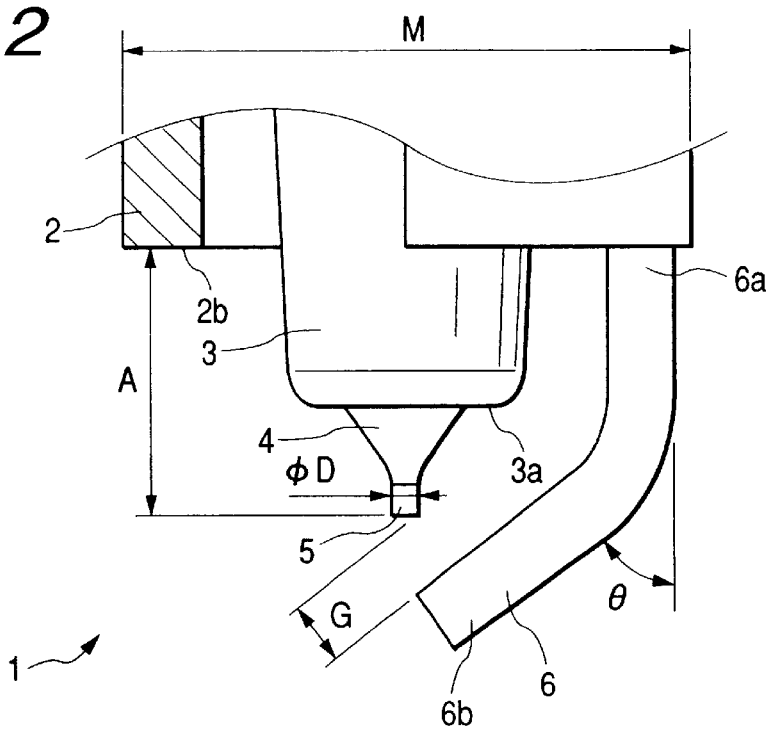
FIG. 2 is a semi-cross sectional and enlarged view showing a substantial part of the spark plug according to the first embodiment of the present invention.

A spark plug according to the first embodiment is shown in FIG. 1 and FIG. 2. As shown in FIG. 1 and FIG. 2, the spark plug 1 according to the first embodiment is provided with a fitting piece 2 having a substantially cylindrical shape and the fitting piece 2 is formed at its periphery with an M10 fitting screw portion 2*a* which has a diameter of substantially M10 and is fixed to an engine block that is not shown.

An insulator 3 is attached inside the fitting piece 2 so as to be supported thereto. The insulator 3 is made of alumina ceramic ($Al_2O_3$), and has an end portion 3*a* and an axial opening 3*b* so that the insulator 3 is tapered toward the end portion 3*a* in the axial direction thereof. A center electrode 4 is secured in the axial opening 3*b* so that the insulator 3 supports and surrounds the periphery of the center electrode 4.

The end portion 3*a* of the insulator 3 is arranged to project from one end surface 2*b* of the fitting piece 2 and the center electrode 4 is arranged to project from the end portion 3*a* of the insulator 3.

The center electrode 4 is a cylinder and has an interior (not shown) made of a highly heat conductive metal such as Cu and an exterior made of a heat-resistant, corrosion-resistant, conductive metal material such as a Ni alloy. The center electrode 4 is provided at its projecting tip end portion with a noble metal chip 5. The noble metal chip 5 is provided with one end surface and other end surface opposite thereto, ant the one end surface thereof is directly welded to be fixed to the tip end portion of the center electrode 4.

The noble metal chip 5 has a substantially cylindrical shape with a diameter D of 0.4 mm so that an area of the other end surface thereof is 0.12 $mm^2$. The 90 wt % of the noble metal chip 5 is made of Ir and the rest thereof is made of Rh.

The spark plug 1 is also provided with a ground electrode 6 which is made of Ni alloy and has one and other end portions 6*a* and 6*b*. The ground electrode 6 is configured so that the one end portion 6*a* thereof is welded to be fixed to the one end surface 2*b* of the fitting piece 2 and other end portion 6*b* thereof is arranged so as to provide a discharge gap G between the other end surface of the noble metal chip 5 and the other end portion 6*b*.

In addition, the ground electrode 6 has a base part extending, in parallel to the axial direction of the spark plug 1, from the one end portion 6*a* up to the vicinity of the end portion 3*a* of the insulator 3 and a chip side part which extends from the base part so as to be bent toward the noble metal chip 5 at a slant angle of θ with respect to the axial direction of the spark plug 1.

In the first embodiment, the slant angle θ is set to 55°.

In addition, in the first embodiment, the discharge gap G is set to 0.8 mm , an axial length A from the one end surface 2*b* up to the other end surface of the noble metal chip 5 is set to 4 mm.

According to the first embodiment, because the spark plug 1 for an internal combustion engine is configured as shown in FIG. 1 and FIG. 2, it is possible to sufficiently keep the heat resistance of the ground electrode 6, and to sufficiently protrude the discharge gap G between the noble chip 5 mounted on the tip end portion of the center electrode 4 and the ground electrode 6.

Second Embodiment

In the second embodiment, the spark plug 1A has a different structural point in the spark plug 1 in the first embodiment in that a ground side noble chip 80 is mounted on an inner surface 6*c* of the other end portion 6*b* of the ground electrode 1 so as to be opposite to the noble metal chip 50 mounted onto the tip end portion of the center electrode 6, whereby to provide the discharge gap G between the ground side noble chip 80 and the noble metal chip 50.

Figure 3:
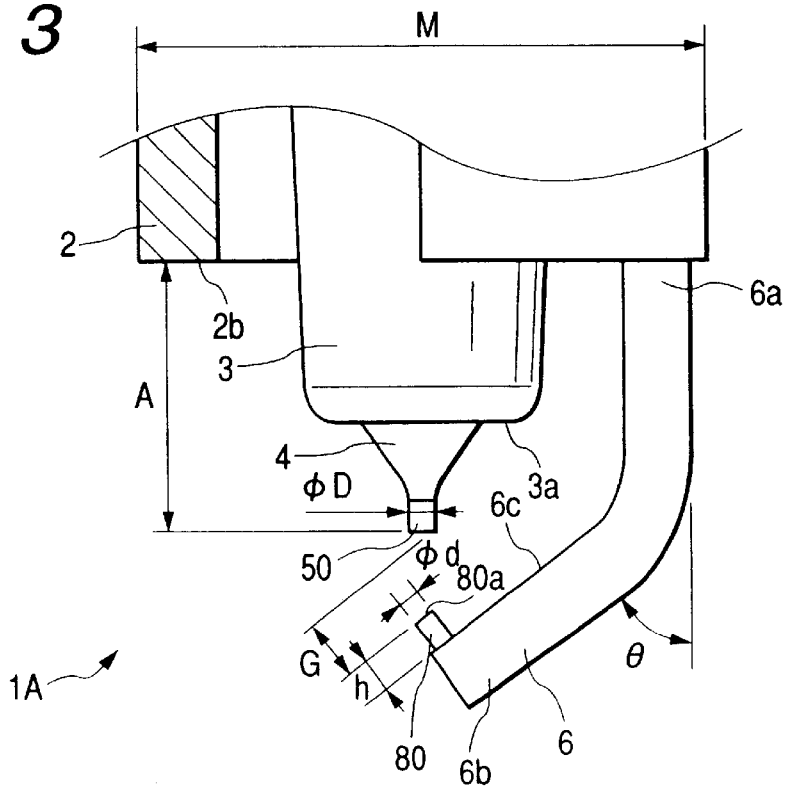
FIG. 3 is a semi-cross sectional and enlarged view showing a substantial part of the spark plug according to a second embodiment of the present invention.

FIG. 3 is a semi-cross sectional and enlarged view showing a substantial part of the spark plug 1A according to the second embodiment.

Incidentally, the elements of the spark plug 1A in FIG. 3 which are the same as those of the spark plug 1 in FIG. 2 are given the same characters in FIG. 2.

In the spark plug 1A in the second embodiment, concretely, the slant angle θ of the ground electrode 6 is set to 55°.

In addition, in the second embodiment, the discharge gap G is set to 0.8 mm, an axial length A from the one end surface 2*b* up to the other end surface of the noble metal chip 50 is set to 4 mm. Moreover, the noble metal chip 50 is formed from an Ir alloy so that the 90 wt % of the chip 50 is made of Ir and the rest thereof is made of Rh. The noble metal chip 50 also has a substantially cylindrical shape with a diameter D of 0.4 mm so that an area of the other end surface of the noble metal chip 50 is 0.12 $mm^2$.

In addition, the ground side noble metal chip 80 is also formed from an Ir alloy, and has a substantially cylindrical shape with a diameter d of 0.4 mm so that an area of an end surface thereof is 0.12 $mm^2$. A height (distance) between the inner surface 6*c* of the other end portion 6*b* of the ground electrode 6 and a tip end surface 80*a* of the ground side noble metal chip 80 is set to 0.8 mm.

According to the second embodiment, because the ground side noble metal chip 80 is provided for the ground electrode 6, the particular operations and the effects are obtained by the structure of the spark plug 1A in the second embodiment, which are described as follows.

That is, because the ground side metal chip 80 is mounted on the ground electrode, in the process of the growth of the flame core which is generated in the discharge gap G provided between the noble metal chip 50 and the ground side noble metal chip 80, it is possible to prevent the flame core from contacting to the ground electrode 6, and therefore, the flame core can efficiently grow.

Moreover, as described above, the ground side noble metal chip 80 can prevent the flame core from contacting to the ground electrode 6 so that it is possible to make short the discharge gap G, thereby decreasing the voltage required for the electrical discharge. Therefore, the load applied on the insulator 3 can be decreased, making it possible to improve the reliability of the spark plug.

Then, the grounds for the numerical ranges of the spark plug according to the present invention are explained in detail hereinafter.

(Set of the Slant Angle θ)

In the present invention, the ground electrode 6 is inclined toward the noble metal chip 5 side so as to make short the length of the ground electrode 6 itself, thereby protruding the spark position A with the heat resistance of the ground electrode improved.

Figure 4A:
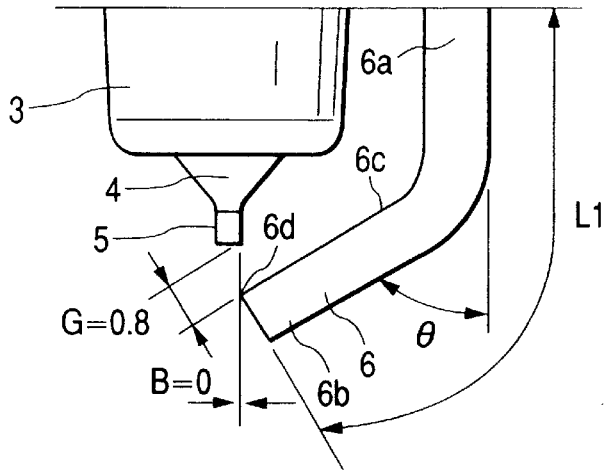
FIG. 4A is a model view showing a configuration of the spark plug according to the present invention.

FIG. 4A shows a configuration of a spark plug for an internal combustion engine when measuring a required length of the ground electrode 6 and a slant angle θ of the spark plug for an internal combustion engine according to the present invention.

Then, the spark plug for an internal combustion engine was used for the measurement, which had a discharge gap G of 0.8 mm, and a corner portion 6*d* on the center electrode side of the inner surface 6*c* of the ground electrode 6 was arranged so that, assuming that the distance between the corner portion 6*d* and the extending line axially extending the side surface of the noble metal chip 5 facing with the ground plate 6 was B, the B was set to 0, that is, the corner portion 6*d* of the ground electrode 6 was located on the extending line.

Figure 4B:
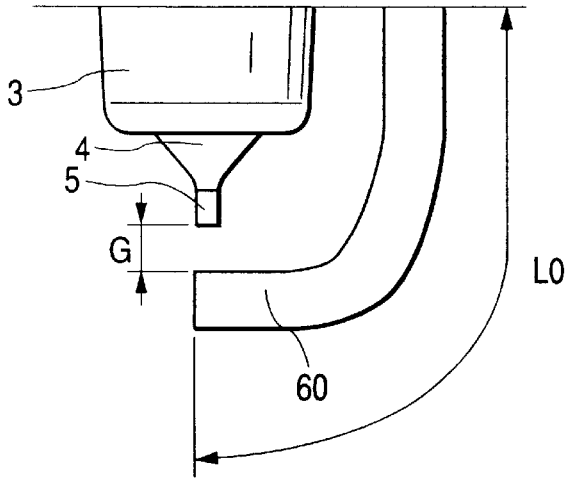
FIG. 4B is a model view showing a configuration of a conventional spark plug.

FIG. 4B shows a required length L0 of a ground electrode 60, which is required for setting a slant angle θ to 90° and providing a discharge gap G between the ground electrode 60 and the noble metal chip 5 mounted onto the tip end portion of the center electrode 3.

Figure 4C:
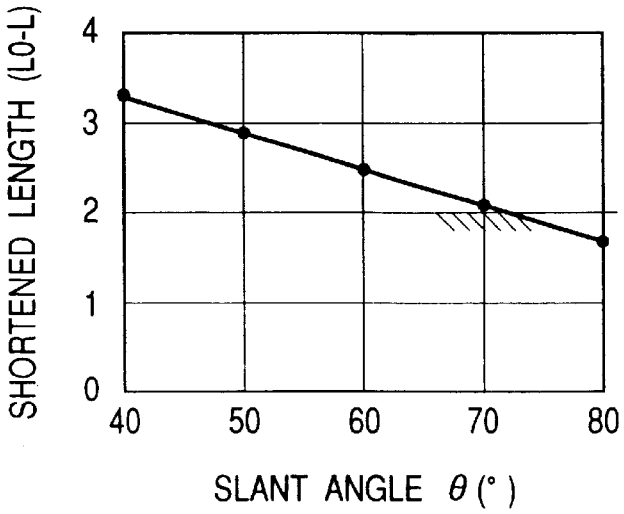
FIG. 4C is a graph showing a relationship between a slant angle θ and a shortened length (L0−L)

Moreover, FIG. 4C shows a relationship between the slant angle θ of the ground electrode 6 and a shortened length (L0−L) thereof which represents the difference between the required length L0 and the required length L, where the required length L is the length required for setting a slant angle to θ and the required length L0 is the length required for setting a slant angle to 90°.

In the spark plug having the fitting piece with the M10 screw portion shown in FIG. 4A, while the spark plug is located in the combustion chamber of the internal combustion engine which is continuously driven for one hundred hours at a speed of 5600 rpm, in order to prevent the ground electrode from dropping out from the fitting piece, the shorten length (L0−L) of the ground electrode needs to be set to 2 mm or more.

The reason for setting the shorten length (L0−L) to 2 mm or more is explained as follows.

That is, because the thickness of the fitting piece of the spark plug having the M10 screw portion, which is referred to "M10 spark plug hereinafter", is smaller than that of the fitting piece of the spark plug having the general M14 screw portion, which is referred to "M14 spark plug hereinafter", the cross-sectional area of the ground electrode fixed to the fitting piece of the M10 spark plug is smaller than that of the ground electrode fixed to the fitting piece of the M14 spark plug.

Therefore, in the case where the ground electrode 6 of the M10 spark plug, which has the same length of the ground electrode of the M14 spark plug, when the length of the ground electrode becomes long, the surface area thereof subjected to the combustion in the combustion chamber becomes large so that the heat resistance of the ground electrode is deteriorated.

Therefore, in the present invention, in order to provide the ground electrode of the M10 spark plug having the heat resistance which is the same as that of the M14 spark plug, it must be required for shortening the ground electrode of the M10 spark plug by at least 2 mm over that of the M14 spark plug.

Then, the preferable slant angle θ, as shown in FIG. 4C, is set so that the shorten length of the ground electrode 6 is set to 2 mm and over, that is, concretely, the preferable slant angle θ needs to be set within the range of 70° or less.

In addition, in the present invention, the ground electrode 6 is arranged to be opposite to the axial length of the spark plug 1 at the slant angle θ.

Figure 5A:
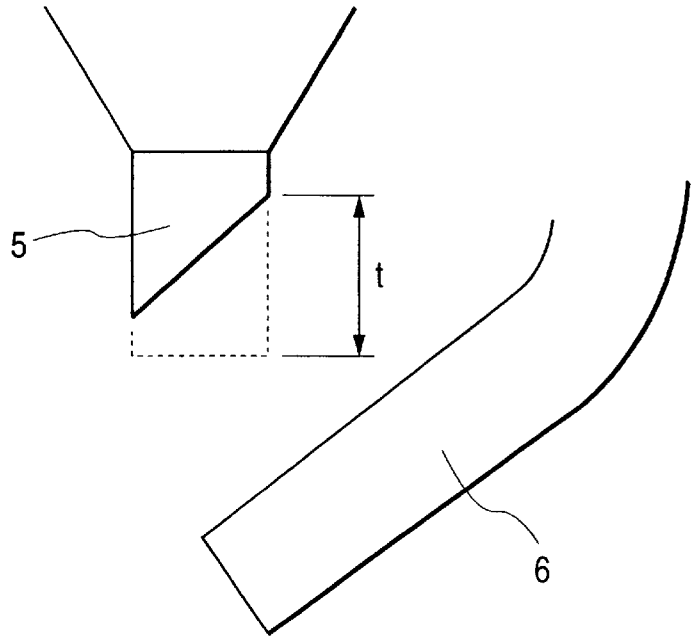
FIG. 5A is a model view showing a configuration of the spark plug according to the present invention.

Thus, as shown in FIG. 5A, the exhaustion portion of the tip end of the noble metal chip 5 due to the spark discharge generated between the noble metal chip 5 and the ground electrode 6 has a wedge-like shape, and the wedge-like shape is formed to be parallel to the inclination of the ground electrode 6.

Therefore, the axial length of the noble metal chip 5 is required to be set in correspondence with the degree of the exhaustion of the noble metal chip 5.

Figure 5B:
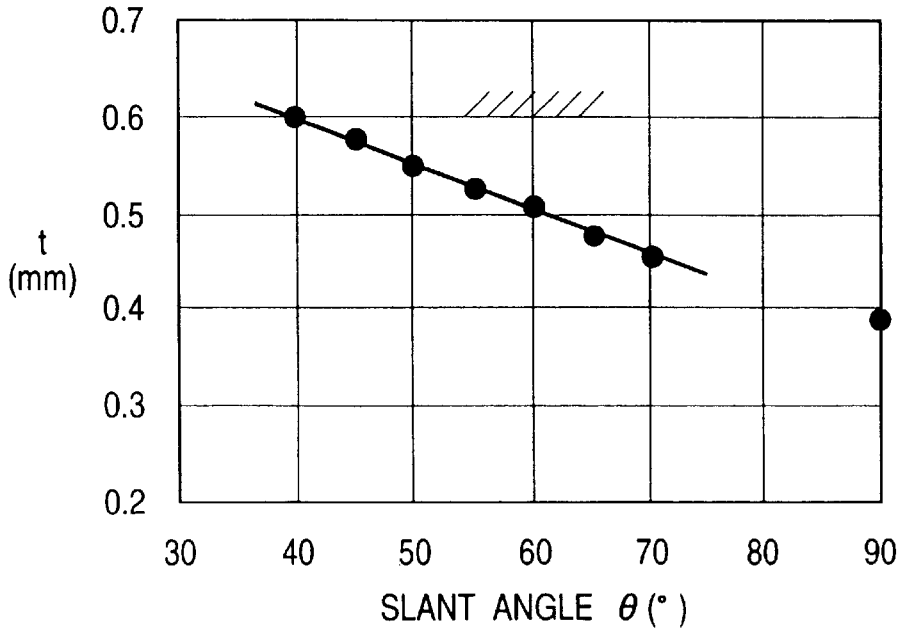
FIG. 5B is a graph showing a relationship between a slant angle θ and an axial length of a noble metal chip.

Here, FIG. 5B shows a relationship between a slant angle θ with respect to the axial length of the ground electrode 6 in the axial direction of the spark plug and the axial length t of the noble metal chip 5 due to the degree of the exhaustion of the noble metal chip 5 mounted onto the tip end portion of the center electrode 4.

Incidentally, in the FIG. 5B, when the spark plug having the noble metal chip 5, whose 90 wt % is made of Ir and whose rest is made of Rh, is located in the combustion chamber of the internal combustion engine which is continuously driven for one hundred hours at a speed of 5600 rpm so that the noble metal chip 5 is exhausted, the axial length t which is required for resisting the exhaustion is shown.

As clearly understood in the FIG. 5B, in the case where the length t of the noble metal chip 5 is longer than 0.6 mm, it is hard to weld the noble metal chip to the tip end portion of the center electrode 4, and the quantity of the noble metal more than needs must be required, thereby increasing the cost of the spark plug.

Therefore, it is preferable that the axial length t of the noble metal chip 5 is not more than 0.6 mm.

As a result, as easily understood in the FIG. 5B, in order to set the axial length t of the noble metal chip 5 to 0.6 mm or less, the slant angle θ of the ground electrode 6 needs to be set to 40° and over.

As described above, the slant angle θ of the ground electrode 6 with respect to the axial direction of the spark plug 1 is preferable to be set within the range of 40° to 70°.

Incidentally, in the FIG. 5B, the optimum lower limit of the slant angle was obtained by using the noble metal chip 5 whose 90 wt % was made of Ir and the rest was made of Rh, but in the case of using other noble metal materials for chips, the above characteristic related to the slant angle was similarly obtained.

(Set of the Gap in the Case of Using the Ground Side Noble Metal Chip)

In the second embodiment of the present invention, because the ground side metal chip 80 is mounted on the ground electrode 6, it is possible to make short the discharge gap G, thereby further decreasing the discharge voltage.

FIG. 6 shows how to decrease the discharge gap G by mounting the ground side noble metal chip.

Figure 6A:
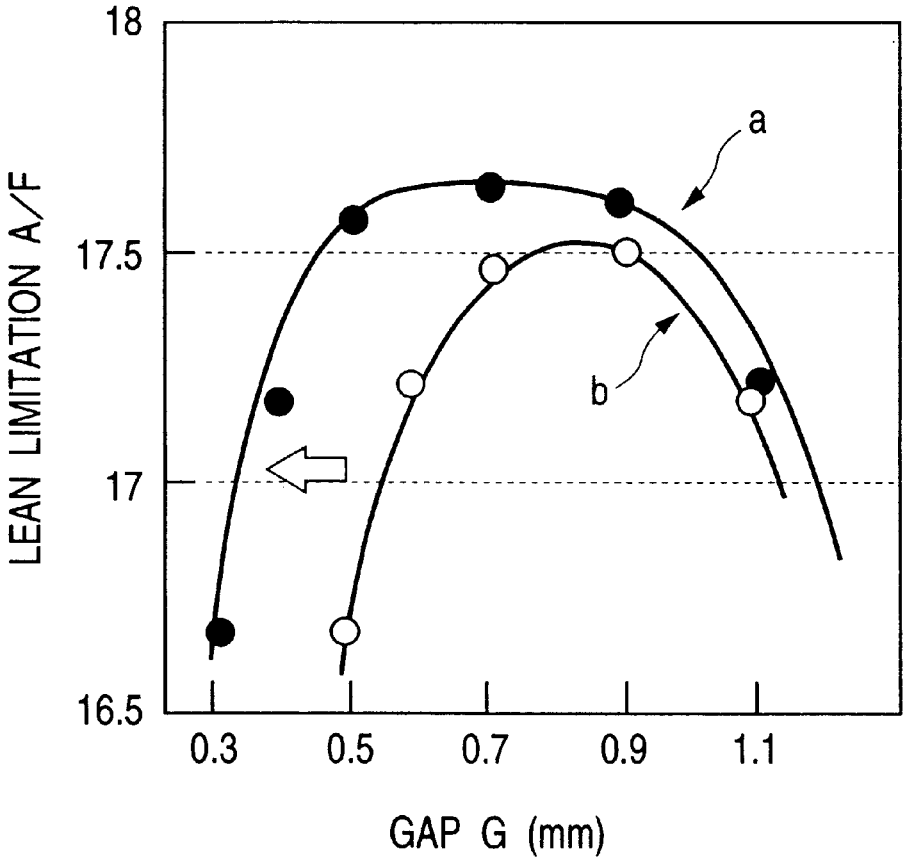
FIG. 6A is a graph showing a relationship between an ignitability and a gap G of the spark plug related to the first embodiment and the second embodiment.

That is, the FIG. 6A shows the relationship between the discharge gap G and the lean limitation so as to show the relationship "a" between the discharge gap G and the ignitability for the case of mounting the noble metal chip 80 to the ground electrode, and show the relationship "b" between the discharge gap G and the ignitability for the case of no use of the noble metal chip 80.

Figure 6B:
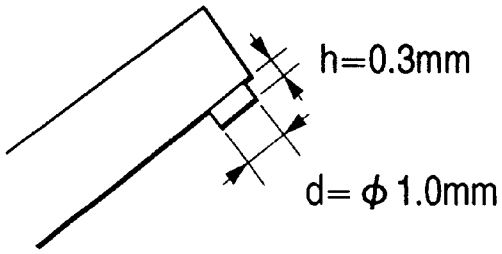
FIG. 6B is a partially enlarged view showing a configuration of a ground side noble metal chip used in FIG. 6A.

Incidentally, when measuring the lean limitation A/F (air-to-fuel ratio) value in FIG. 6A, as shown in FIG. 6B, the diameter d of the ground side noble metal chip was set to 1.0 mm, the height h thereof was set to 0.3 mm. Moreover, the measurement of the lean limitation A/F value is performed for two minutes by igniting the spark plug in the four-cylinder, 1.6 litter engine which was driven under idling conditions that the engine speed was 650 rpm, so that the lean limitation A/F value was obtained at the time that two or more misfires are occurred while the measurement is performed.

As clearly understood in FIG. 6A, because of providing the ground side noble metal chip for the ground electrode of the spark plug, it was revealed that, as compared with the spark plug without providing the ground side noble metal chip, even if the gap was set to a small size of 0.2 mm, it was possible to obtain a sufficient ignitability of the spark plug with the ground side noble metal chip, wherein the sufficient ignitability was the same as the spark plug without the ground side noble metal chip.

However, even if the ground side noble metal chip was mounted on the ground electrode, in the case where the discharge gap between the noble metal chip and the ground side noble metal chip was shorter than 0.5 mm, eventually, the lean limitation A/F value became 17.5 which was the same as the ignitability obtained when the discharge gap was set to 1.0 mm and the screw diameter of the fitting piece (housing) was set to M14, so that it was proved that it was unable to obtain a sufficient ignitability.

Figure 7:
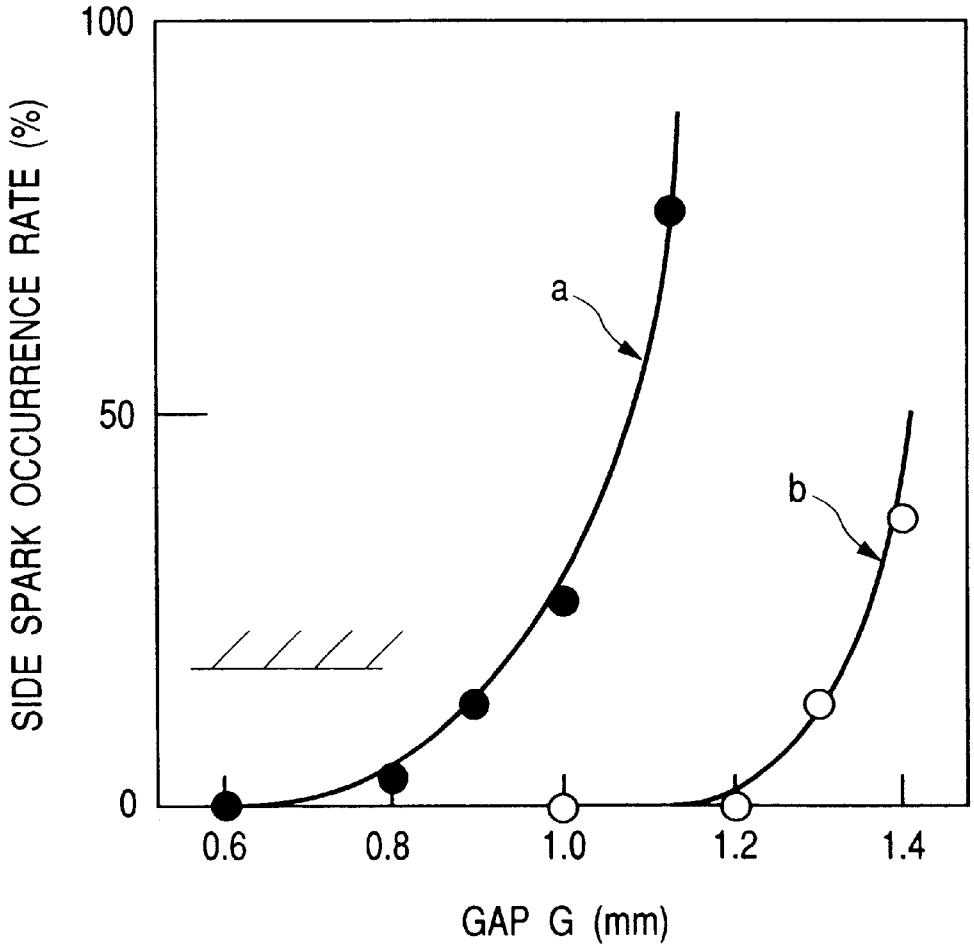
FIG. 7 is a graph showing a relationship between a side spark occurrence rate and a gap G of the spark plug for the internal combustion engine according to the second embodiment.

Next, in the spark plug which is the same as the spark plug used in the measurement shown in FIG. 6, the relationship between the discharge gap G and the side spark occurrence rate was shown in FIG. 7. Where the side spark occurrence rate was measured for two hours by igniting the spark plug in the four-cylinder, 1.6 litter engine which was driven under idling conditions that the engine speed was 650 rpm.

In FIG. 7, "a" shows the relationship in the case of using the spark plug with the fitting piece whose screw diameter is set to M10, and "b" shows the relationship in the case of using the spark plug with the fitting piece whose screw diameter is set to M14.

As clearly shown in FIG. 7, in the case of using the spark plug with the fitting piece (housing) whose screw diameter is set to M14, because the insulator and the ground electrode are sufficiently far from each other, even if the gap G is set to 1.3 mm, no side spark is generated.

However, in the case of using the spark plug with the fitting piece (housing) whose screw diameter was set to M10, when the discharge gap was longer than 0.9 mm, even if the spark plug had the structure according to the present invention, because the side spark occurrence rate was exceeded 20%, it was revealed that the spark plug was not practical.

As described above, because of mounting the ground side noble metal chip 80 on the ground electrode 6, it was possible to make short the discharge gap of the spark plug with the fitting piece whose screw diameter was M10, concretely, it was revealed that the discharge gap G with the ground side noble metal chip was preferable to be set to the range defined by the following expression:

$$0.5\ \text{mm} \leqq G \leqq 0.9\ \text{mm}.$$

(Set of the Diameter of the Ground Side Noble Metal Chip)

Next, the diameter of the ground side noble metal chip having the substantially cylindrical shape and mounted on the ground electrode 6 was examined.

Figure 8A:
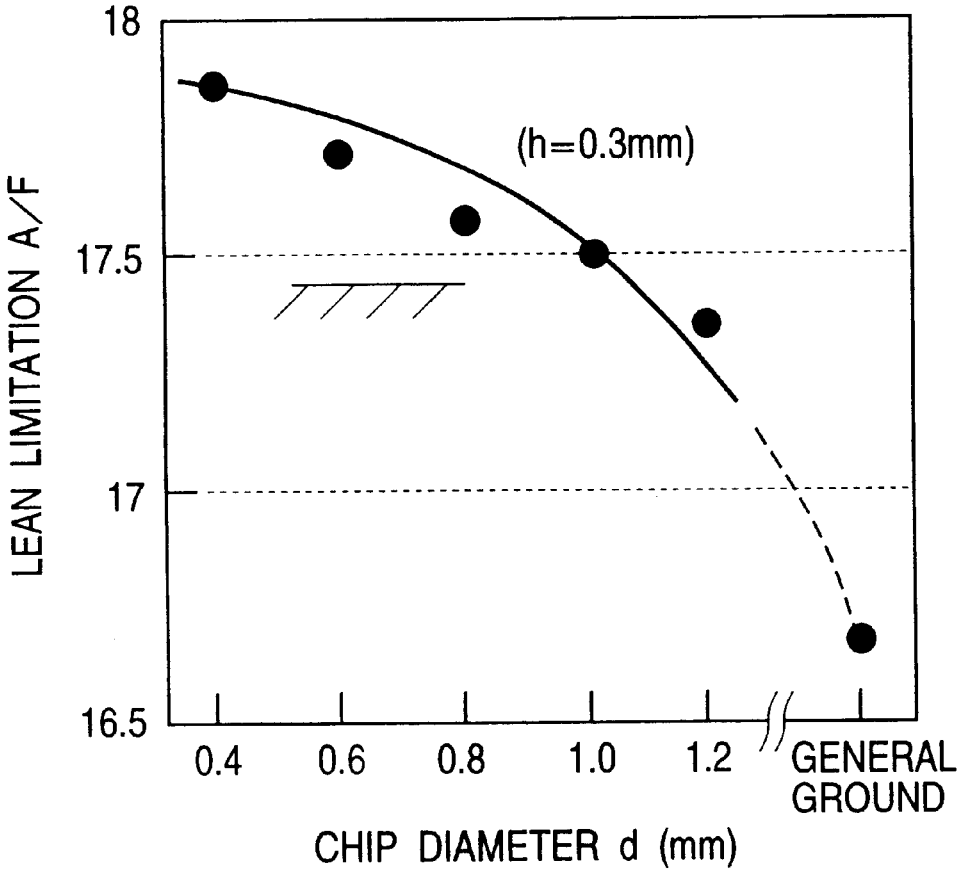
FIG. 8A is a graph showing a relationship between a diameter d of the ground side noble metal chip and the ignitability.
Figure 8B:
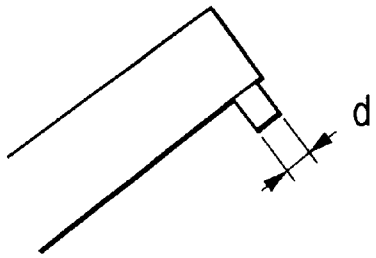
FIG. 8B is a view showing the diameter d of the ground side noble metal chip.

In FIG. 8A, in order to show the relationship between the chip diameter d of the ground side noble metal chip 80 and the ignitability, the relationship between the chip diameter d which is shown in FIG. 8B and the lean limitation A/F is shown. Then, the lean limitation A/F was measured in the same manner of measuring the lean limitation A/F in FIG. 6A. Similarly to the measurement in FIG. 6A, the ignitability of the spark plug was set, that has the fitting piece whose screw diameter was set to M14 and the discharge gap thereof was set to 1.0 mm.

Moreover, for the measurement in FIG. 8A, the spark plug was used, that had the same dimensions as the spark plug shown in FIG. 3 and, in addition to the structure, had the ground side noble metal chip 80 with the height of 0.8 mm, which was arranged so that the discharge gap G between the ground side noble metal chip 80 and the noble metal chip was set to 0.8 mm.

As clearly shown in FIG. 8A, in the case where the diameter of the noble metal chip is more than 1.0 mm, the flame core generated in the discharge gap is easy to contact the noble metal chip with the large diameter. Thus, the flame of the flame core is easy to escape to the chip side so as to prevent the growth of the flame core. Therefore, the lean limitation A/F value was 17.5 so that it was revealed that it was impossible to obtain a sufficient ignitability.

As described above, it was revealed that the diameter d of the ground side noble metal chip was preferable to be set to 1.0 mm or less, that is, the area of the end surface of the ground side noble metal chip was preferable to be set to 0.8 $mm^2$ or less.

(Set of the Height of the Ground Side Noble Metal Chip)

Next, the height of the ground side noble metal chip mounted on the ground electrode 6 was examined.

Figure 9A:
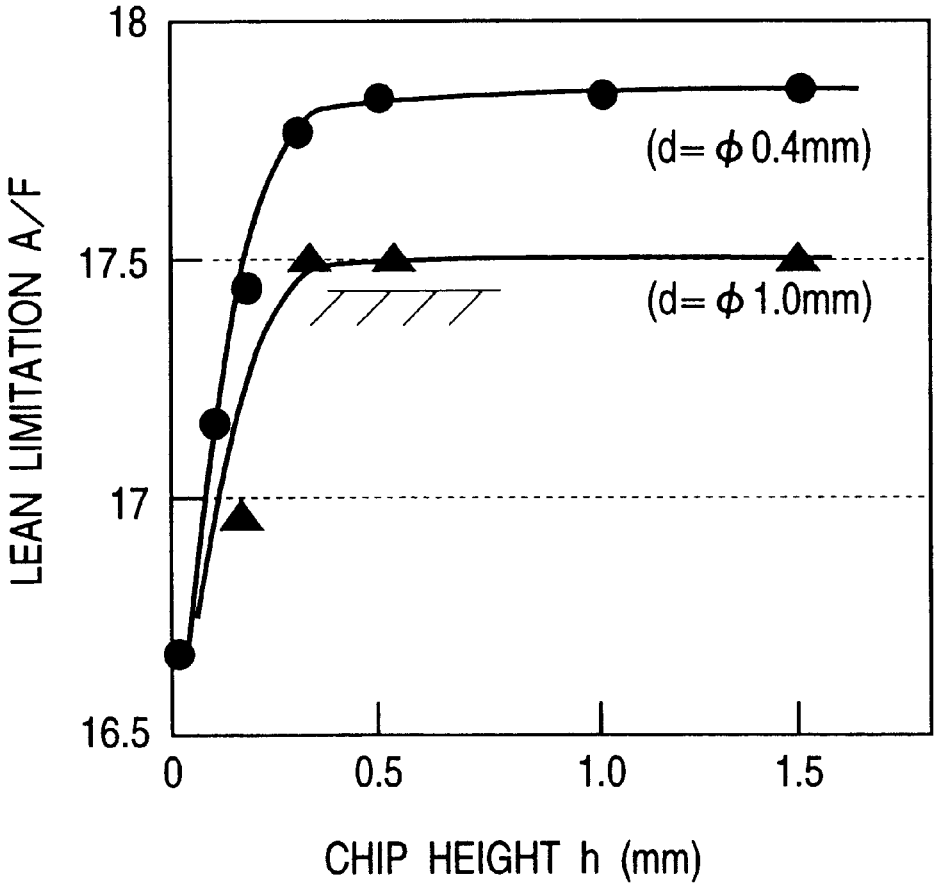
FIG. 9A is a graph showing a relationship between a height h of the ground side noble metal chip and the ignitability.
Figure 9B:
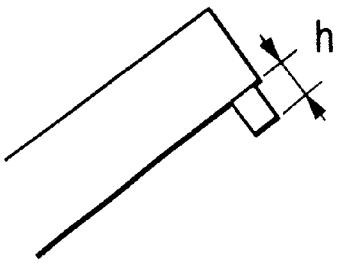
FIG. 9B is a view showing the height h of the ground side noble metal chip.

In FIG. 9A, in order to show the relationship between the chip height h of the ground side noble metal chip 80 and the ignitability, the relationship between the chip height h which is shown in FIG. 9B and the lean limitation A/F is shown. Then, the lean limitation A/F was measured in the same manner of measuring the lean limitation A/F in FIG. 6A. Similarly to the measurement in FIG. 6A, the ignitability of the spark plug was set, that has the fitting piece whose screw diameter was set to M14 and the discharge gap thereof was set to 1.0 mm.

Moreover, for the measurement in FIG. 9A, two types of spark plugs were used, one type of which had the same dimensions as the spark plug shown in FIG. 3 and, in addition to the structure, had one type of the ground side noble metal chip 80 having the chip diameter of 0.4 mm corresponding to the area of the end surface 0.12 $mm^2$, and other type of which had the same dimensions as the spark plug shown in FIG. 3 and, in addition to the structure, had other type of the ground side noble metal chip 80 having the chip diameter of 1.0 mm corresponding to the area of the end surface 0.80 $mm^2$.

In the case of using the other type of spark plug with the ground side noble metal chip whose diameter had 1.0 mm, which had the inferior ignitability as compared with the one type of spark plug (referred to FIG. 8A), as clearly shown in FIG. 9A, when setting the height of the ground side metal chip to 0.3 mm or more, it was possible to obtain a sufficient ignitability.

As described above, it was revealed that the height h of the ground side noble metal chip, when the chip diameter d thereof was set within the range of 0.4 mm to 1.0 mm, that is, the area of the end surface of the ground side noble metal chip is set within the range of 0.12 $mm^2$ to 0.80 $mm^2$, was preferable to be set to 0.3 mm or more.

(Other Configuration)

Incidentally, in the first and second embodiments, the tapered insulator toward the end portion 3*a* is used for each spark plug, but the present invention is not limited to the structure.

Figure 10:
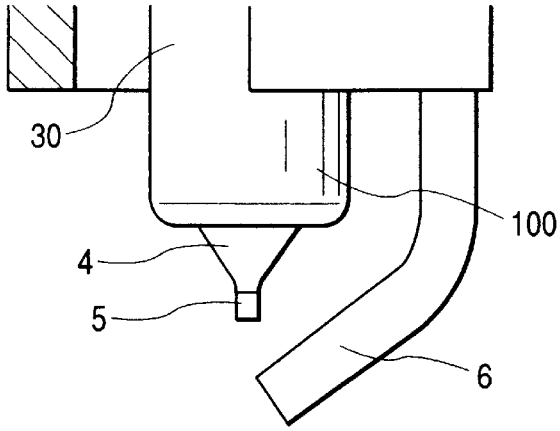
FIG. 10 is a semi-cross sectional and enlarged view showing a substantial part of a spark plug according to a modification of the present invention.
Figure 11:
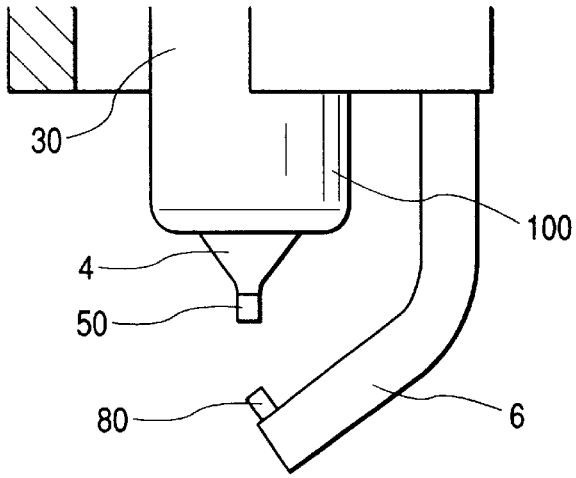
FIG. 11 is a semi-cross sectional and enlarged view showing a substantial part of a spark plug according to a modification of the present invention.

For example, as shown in FIG. 10 and FIG. 11, the insulator 30 may be used in the spark plug, that is formed at its one end side with a body portion 100 whole of which has the same diameter in an axial direction thereof.

Especially, because the body portion 100 is formed to the one end side of the insulator 30, it is possible to extend a least distance between the insulator 30 and the fitting piece 2 in an air, making it possible to prevent the generation of the side spark.

Moreover, in each of the first and second embodiments, the chip side part of the grounding electrode 6 extends from the base part so as to be linearly bent toward the noble metal chip 5 at a slant angle of θ, but the present invention is not limited to the structure.

Figure 12:
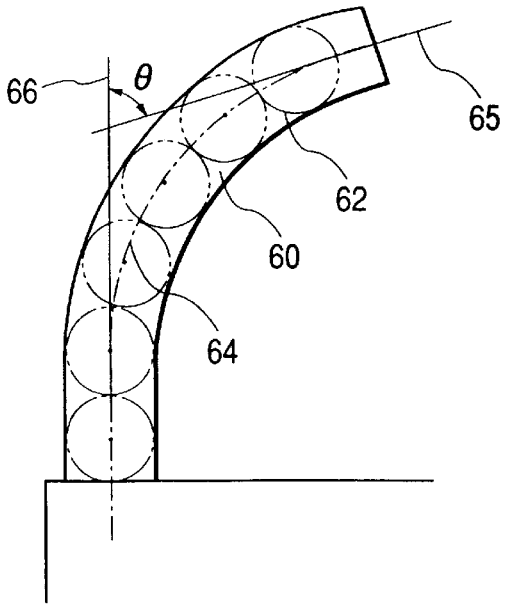
FIG. 12 is an enlarged view showing a substantial part of a spark plug according to a modification of the present invention.

That is, as shown in FIG. 12, the ground electrode 60 may be configured to extend to be slightly curved from the one end portion 6*a* toward the noble metal chip 5. In this case, assuming that supposition continuous circles 62 each having a diameter which corresponds to a thickness of the ground electrode 60 are drawn and a curved line 64 is drawn to connect each center of each circle 62, two tangential lines 65 and 66 tangential to the curved line 64 are crossed so as to form a crossing angle θ so that the crossing angle θ is set to the slant angle θ with respect to the axial direction of the spark plug of the present invention.

Still furthermore, in each embodiment, the noble metal chip having a cylindrical shape with circular cross section is used, but the present invention is not limited to the structure. Providing that the area of the end surface of an noble metal chip is set within a range of 0.07 $mm^2$ to 0.55 $mm^2$, the noble metal chips may be used, for example, one of which has a cylindrical shape so that an end surface thereof is formed as an elliptical shape or a starred shape, or another one of which has a barrel shape.

Similarly, in each embodiment, the ground side noble metal chip 80 having a cylindrical shape with circular cross section is used, but the present invention is not limited to the structure. Providing that the area of the end surface of an noble metal chip is set within a range of 0.12 $mm^2$ to 0.80 $mm^2$, the ground side noble metal chips may be used, for example, one of which has a cylindrical shape so that an end surface thereof is formed as an elliptical shape or a starred shape, or another one of which has a barrel shape.

Incidentally, in each embodiment, each of the noble metal chip and the ground side noble metal chip is formed so that the 90 wt % of each of which is made of Ir and the rest thereof is made of Rh. However, the present invention is not limited to the component.

That is, each of the noble metal chip and the ground side noble metal chip may be made of Ir alloy whose at least 60 wt % consists of Ir. For example, as the Ir alloy, pure Ir, Ir—Pt alloy, Ir—Rh alloy and Ir—Ni alloy can be used.

In addition, each of the noble metal chip and the ground side noble metal chip may be made of Pt alloy whose at least 60 wt % consists of Pt. For example, the Pt alloy can be formed by adding at least one of pure Pt, Ir, Ni, Pd, Ru and W.

While there has been described what is at present considered to be the preferred embodiments and modifications of the present invention, it will be understood that various modifications which are not described yet may be made therein, and it is intended to cover in the appended claims all such modifications as fall within the true spirit and scope of the invention.

What is claimed is:

1. A spark plug for an internal combustion engine, comprising:

a center electrode with an end portion;

an insulator surrounding a periphery of the center electrode to support the center electrode;

a fitting piece that supports the insulator, said fitting piece being provided with an end surface and at a periphery thereof with a fitting screw portion, said end portion of the center electrode projecting from the end surface of the fitting piece, said fitting screw portion having a diameter of M10;

a noble metal chip with one end surface and other end surface opposite thereto, said one end surface being mounted on the end portion of the center electrode, said other end surface being arranged so that an axial distance A between the end surface of the fitting piece and the other end surface of the noble metal chip is set within a range of 3 mm to 8 mm, said other end surface having an area S which is set within a range of 0.07 $mm^2$ to 0.55 $mm^2$; and a ground electrode having one end portion and other end portion, said one end portion thereof being fitted to the end surface of the fitting piece, said other end portion being inclined toward the noble metal chip at a slant angle of θ with respect to an axial length of the spark plug so as to provide a discharge gap G between the noble chip and the other end portion, said slant angle θ being set within a range of 40° to 70°, said discharge gap G being set within a range of 0.7 mm to 0.9 mm.

2. A spark plug for an internal combustion engine according to claim 1, wherein said noble metal chip is made of at least one of Ir alloy and Pt alloy, at least 60 wt % of said Ir alloy consisting of Ir, at least 60 wt % of said Pt alloy consisting of Pt.

3. A spark plug for an internal combustion engine according to claim 2, wherein said Ir alloy is one of pure Ir, Ir—Pt alloy, Ir—Rh alloy and Ir—Ni alloy, and said Pt alloy is formed by adding at least one of pure Pt, Ir, Ni, Pd, Ru and W.

4. A spark plug for an internal combustion engine according to claim 1, wherein said insulator has a substantially cylindrical shape and is formed at a chip side end with a body portion whole of which has a same diameter in an axial direction thereof.

5. A spark plug for an internal combustion engine, comprising:

a center electrode with an end portion;

an insulator surrounding a periphery of the center electrode to support the center electrode;

a fitting piece that supports the insulator, said fitting piece being provided with an end surface and at a periphery thereof with a fitting screw portion, said fitting screw portion having a diameter of M10;

a noble metal chip with one, end surface and other end surface opposite thereto, said one end surface being mounted on the end portion of the center electrode, said other end surface being arranged so that an axial distance A between the end surface of the fitting piece and the other end surface of the noble metal chip is set within a range of 3 mm to 8 mm, said other end surface having an area S1 which is set within a range of 0.07 $mm^2$ to 0.55 $mm^2$;

a ground electrode having one end portion and other end portion, said one end portion thereof being fitted to the end surface of the fitting piece, said other end portion being inclined toward the noble metal chip at a slant angle of θ with respect to an axial length of the spark plug, said slant angle θ being set within a range of 40° to 70°; and a ground side noble metal chip mounted on the other end portion of the ground electrode so as to provide a discharge gap G between the noble chip and the ground side noble metal chip, said discharge gap G being set within a range of 0.5 mm to 0.9 mm.

6. A spark plug for an internal combustion engine according to claim 5, wherein said ground side noble metal chip is provided with an end surface opposite to the noble metal chip, said end surface of the ground side noble metal chip having an area S2, said area S2 being set within a range of 0.12 $mm^2$ to 0.80 $mm^2$.

7. A spark plug for an internal combustion engine according to claim 5, wherein said ground side noble metal chip is mounted on a surface of the other end portion of the ground electrode and has a height h between the end surface thereof and the surface of the other end portion of the ground electrode, said height h being set within a range of 0.3 mm to 1.5 mm.

8. A spark plug for an internal combustion engine according to claim 5, wherein at least one of said noble metal chip and said ground side noble metal chip is made of at least one of Ir alloy and Pt alloy, at least 60 wt % of said Ir alloy consisting of Ir, at least 60 wt % of said Pt alloy consisting of Pt.

9. A spark plug for an internal combustion engine according to claim 8, wherein said Ir alloy is one of pure Ir, Ir—Pt alloy, Ir—Rh alloy and Ir—Ni alloy, and said Pt alloy is formed by adding at least one of pure Pt, Ir, Ni, Pd, Ru and W.

10. A spark plug for an internal combustion engine according to claim 5, wherein said ground side noble metal chip has a substantially cylindrical shape and a diameter of the end surface of the noble metal chip is set within a range of 0.4 mm to 1.0 mm.

* * * * *